United States Patent [19]

Compen et al.

[11] Patent Number: 4,550,032

[45] Date of Patent: Oct. 29, 1985

[54] ELECTRIC DISCHARGE TUBE AND METHOD OF MANUFACTURING AN ELECTRICALLY CONDUCTIVE LAYER ON A WALL PORTION OF THE ENVELOPE OF SUCH A TUBE

[75] Inventors: Johannes M. A. A. Compen; Wilhelmus M. P. van Kemenade, both of Eindhoven, Netherlands

[73] Assignee: U.S. Philips Corporation, New York, N.Y.

[21] Appl. No.: 585,067

[22] Filed: Mar. 1, 1984

[30] Foreign Application Priority Data

Mar. 14, 1983 [NL] Netherlands ..... 8300914

[51] Int. Cl.[4] ..... B05D 5/06; B05D 5/12

[52] U.S. Cl. ..... 427/64; 427/68; 313/479; 252/510

[58] Field of Search ..... 313/479, 480, 450; 427/64, 68, 106, 397.7; 252/506, 510

[56] References Cited

FOREIGN PATENT DOCUMENTS 57-50753 3/1982 Japan ..... 313/479

*Primary Examiner*—Norman Morgenstern
*Assistant Examiner*—Ken Jaconetty
*Attorney, Agent, or Firm*—Norman N. Spain

[57] ABSTRACT

An electrically conductive layer on a wall portion of the envelope of an electric discharge tube which comprises an electrically conductive material and at least 5% by weight of silicon dioxide as an adhesive, adheres readily, is hard and can be washed with water.

Such a layer can be obtained from a suspension comprising an electrically conductive material and a binder in a solvent, in which the binder is a quaternary ammonium silicate or a solution of silicon dioxide ($SiO_2$) in phosphoric acid ($H_3PO_4$), in which the mol ratio $SiO_2/P_2O_5$ is between 0.3:1 and 20:1.

8 Claims, 1 Drawing Figure

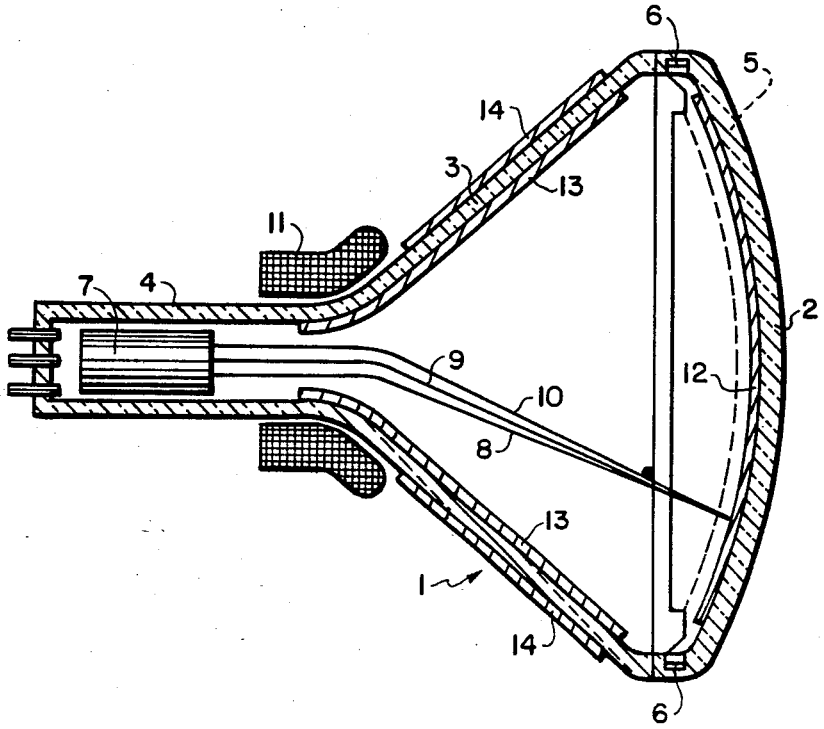
6
5
14
3
13
11
7
4
2
9
12
10
8
13
1
14
6

ELECTRIC DISCHARGE TUBE AND METHOD OF MANUFACTURING AN ELECTRICALLY CONDUCTIVE LAYER ON A WALL PORTION OF THE ENVELOPE OF SUCH A TUBE

The invention relates to an electric discharge tube comprising an evacuated envelope having an electrically conductive layer on a wall portion of said envelope. The electrically conductive layer may be provided in the form of a strip.

The invention also relates to two methods of manufacturing an electrically conductive layer on a wall portion of the envelope of such an electric discharge tube, comprising the following steps:

(a) manufacturing a suspension comprising an electrically conductive material and a binder in a solvent, (b) providing a layer of said suspension on a wall portion of the envelope, (c) drying and optionally firing the layer.

Such an electric discharge tube may be, for example, a cathode ray tube, for example a display tube or a television camera tube, or an X-ray image intensifier tube.

Such an electric discharge tube and a method of manufacturing an electrically conductive layer on a wall portion of the envelope of such an electric discharge tube are known from Netherlands Patent Application No. 7316104 (PHN 7238) laid open to public inspection. In the method disclosed in said Patent Application, an aqueous suspension comprising 20–30% by weight of graphite powder as an electrically conductive material, 10–15% by weight of an alkali metal silicate, for example, potassium silicate as a binder and 4% by weight of sodium nitrate as an agent to prevent bubble formation in the layer, completed to 100% with water is obtained by intimate mixing. Sometimes a filler (2 to 70% by weight of the suspension), for example iron oxide power ($Fe_2O_3$) or titanium oxide powder ($TiO_2$) is used in such suspensions.

A graphite suspension for manufacturing electrically conductive layers is also known from German Patent Specification No. 1,564,508. In addition to graphite as an electrically conductive material, said suspension comprises a filler, for example zinc oxide and an alkali metal silicate, for example, water glass, as an adhesive, and in addition dispersed silica ($SiO_2$) and lampblack to delay the sedimentation. As a result of this retardation of the sedimentation, the suspension is stabilised. An electrically conductive coating manufactured from this suspension comprises a homogeneous vitreous layer of alkali metal silicate which serves as an adhesive in which particles of graphite, lampblack, filler and $SiO_2$ are present.

After providing the layer it is desirable to wash the wall portions with water so as to remove any loose particles and any other impurities. However, the layers comprising alkali metal silicate are insufficiently water-resistant. Moreover, there exists a need for harder, better adhering layers.

It is therefore an object of the invention to provide an electric discharge tube, as well as two methods of manufacturing same, in which a well adherent, sufficiently hard, water-washable, electrically conductive layer or strip which does not comprise an alkali metal silicate is provided on a wall portion of the envelope.

According to the invention, an electric discharge tube of the kind mentioned in the opening paragraph is characterized in that the electrically conductive layer comprises an electrically conductive material and at least 5% by weight of silicon dioxide as an adhesive.

A first method of manufacturing an electrically conductive layer on a wall portion of the envelope of an electric discharge tube according to the invention comprising the following steps:

(a) manufacturing a suspension comprising at least an electrically conductive material and a binder in a solvent, (b) providing a layer of said suspension on a wall portion of the envelope, (c) drying and optionally firing the layer, is characterized according to the invention in that the binder is a quaternary ammonium silicate. This is preferably formed by dissolving silicon dioxide in a quaternary ammonium hydroxide solution in which the quaternary ammonium hydroxide may be described as $NR_4OH$, wherein R is an aryl group or an alkyl group. When firing the electric discharge tube envelop a skeleton of pure silicon dioxide ($SiO_2$) as an adhesive is formed in the layer as a result of which inter alia the water resistance is obtained. Another advantage is that the suspension may comprise quick-drying organic solvents, for example alcohols and ketones, without flocculation occurring.

In order to obtain a better decomposition of the silicates formed with the quaternary ammonium base upon firing the envelope so that the skeleton of pure silicon dioxide ($SiO_2$) is formed, R is preferably chosen to be small, for example a methyl group or an ethyl group.

A second method of manufacturing an electrically conductive layer or strip on a wall portion of the envelope of the electric discharge tube according to the invention is characterized in that the binder is a colloidal solution of silicon dioxide ($SiO_2$) in phosphoric acid ($H_3PO_4$), in which the mol ratio $SiO_2/P_2O_5$ is between 0.3:1 and 20:1. By means of this method a sufficiently hard, well adhering electrically conductive layer is also obtained. With a mol ratio $SiO_2/P_2O_5$ of 1:1, the adhesion and hardness of the layer or strip is optimum.

The invention will now be described in greater detail, by way of example, with reference to a number of examples and a FIGURE which is a longitudinal sectional view of a colour display tube.

The starting material in all the examples is a basic graphite suspension which is composed as follows:

Basic graphite suspension.

225 g of graphite (Lonza ks 2.5 a trade name of messrs. Lonza, Basel, Switzerland) or another graphite having a comparable grain size ($d_{50}=1.8$ $\mu$m).

325 g of distilled water 850 g of protective colloid solution 5% (for example a starch derivative)

These ingredients are ground in a ball mill for 2 to 200 hours.

EXAMPLE 1

A suspension which may be used to provide an electrically conductive layer on a wall portion of the envelope of the tube by pouring can be obtained as follows:

Prepare a mixture of:

200 g of the basic graphite suspension as defined above 100 g of distilled water 62 g of TMAH solution 25% (for example from Messrs. Fluka, Buchs, Switzerland) and 68 g of colloidal $SiO_2$ solution 30% (Ludox AM, a trade name of Dupont) and roll or stir this mixture for 24 hours.

(TMAH=Tetra-Methyl-Ammonium-Hydroxide).

The distilled water may be replaced wholly or partly by, for example, methanol, ethanol, isopropanol or acetone.

EXAMPLE 2

A suspension of the type described in Example 1 may also be obtained as follows:

Prepare a mixture of 68 g of colloidal $SiO_2$ solution 30% (Ludox AM) and 100 g of TEAH-solution 20% (for example from Messrs. Fluka, Buchs, Switzerland) and roll or stir this mixture for 24 hours.

Then add 100 g of distilled water and 200 g of the basic graphite suspension and roll or stir this mixture for 1 hour.

(TEAH=Tetra-Ethyl-Ammonium-Hydroxide).

EXAMPLE 3

A suspension which can be provided on a wall portion of the envelope of the tube by means of a brush so as to obtain an electrically conductive layer can be composed as follows.

Prepare a mixture of 200 g of the basic graphite suspension 100 g of $Fe_2O_3$ 140 g of colloidal $SiO_2$ solution 30% (Ludox SM, a tradename of Dupont)

125 g of TMAH solution 25% and roll said mixture for 24 hours in a ball mill.

EXAMPLE 4

A suitable suspension which can be sprayed is obtained as follows:

Take 68 g of colloidal $SiO_2$ solution 30% (Ludox AM)

34 g of $H_3PO_4$ 85%

34 g of distilled water

Then add 200 g of the basic graphite suspension.

EXAMPLE 5

Another suspension suitable for spraying can be obtained as follows:

Take 70 g of colloidal $SiO_2$ solution 30% (Ludox AM) and 80 g of $H_3PO_4$ 85% and stir this mixture for 1 hour and then add 70 g of distilled water.

Then take 70 g of the binder thus formed and add 200 g of the basic graphite suspension. 5–80 g of $TiO_2$ may optionally be added as a filler (for example, type R-cR2 of Messrs. Tioxide International, London).

Electrically conductive layers and/or strips can be provided both on the inner wall and on the outer wall of the envelope of tubes by means of the suspensions described in the Examples.

The electric discharge tube shown in the longitudinal sectional view in the FIGURE is a colour display tube. It comprises a glass envelope 1 which has a substantially rectangular display window 2, a conical central portion 3 and a neck 4. A pattern of phosphors 12 luminescing in the colours red, green and blue is provided on the display window 2. At a short distance before the display window 2 a colour selection electrode 5 is provided via suspension means 6. An electron gun 7 for generating three electron beams 8, 9 and 10 is mounted in the neck 4 of the tube. These three beams are deflected by means of a system of deflection coils 11 placed around the tube and they intersect each other substantially at the area of the display window 2, after which each of the electron beams impinges only on one of the three phosphors provided on the display screen.

During the manufacture of such a colour display tube, a layer of any one of the suspensions as described in Examples 1 to 5 is provided on the inside and on the outside of a wall portion of the envelope of the colour display tube by pouring, spraying or by means of a brush. After drying the layer, the layer may be fired, if so desired, the electrically conductive layers 13 and 14 are formed. These layers have a sufficient hardness and a very good adhesion. The so-called "pencil hardness" of the various layers according to the invention varies in the examples from HB to large than 9H measured according to the Dutch standard NEN5350 (1970). Moreover during the finishing treatment the tube may be rinsed with water because the layers are water-resistant.

What is claimed is:

1. A method of manufacturing an electrically conductive layer, comprising an electrically conductive material and at least 5% by weight of silicon dioxide as an adhesive, on a wall portion of an evacuated envelope of an electric discharge tube comprising the following steps:

(a) manufacturing a suspension comprising at least an electrically conductive material and a binder in a solvent, (b) providing a layer of said suspension on a wall portion of said envelope, and (c) drying said layer by heating and optionally firing said layer, characterized in that the binder is a quaternary ammonium silicate.

2. A method as claimed in claim 1, characterized in that the quaternary ammonium silicate is formed by dissolving silicon dioxide in a quaternary ammonium hydroxide solution in which the quaternary ammonium hydroxide may be described as $NR_4OH$, wherein R is an aryl group or an alkyl group.

3. A method as claimed in claim 2, characterized in that R is a methyl group or an ethyl group.

4. A method as claimed in claim 1, characterized in that the solvent is a quick-drying organic solvent.

5. A method as claimed in claim 2, characterized in that the solvent is a quick-drying organic solvent.

6. A method as claimed in claim 3, characterized in that the solvent is a quick-drying organic solvent.

7. A method of manufacturing an electrically conductive layer, comprising an electrically conductive material and at least 5% by weight of silicon dioxide as an adhesive, on a wall portion of an evacuated envelope of an electric discharge tube comprising the following steps:

(a) manufacturing a suspension comprising at least an electrically conductive material and a binder in a solvent, (b) providing a layer of said suspension on a wall portion of said envelope, and (c) drying said layer by heating and optionally firing said layer, characterized in that the binder is a colloidal solution of silicon dioxide ($SiO_2$) in phosphoric acid ($H_3PO_4$) in which the mol ratio $SiO_2/P_2O_5$ is between 0.3:1 and 20:1.

8. A method as claimed in claim 7, characterized in that the mol ratio $SiO_2/P_2O_5$ is approximately 1:1.

* * * * *